US012427379B2

(12) United States Patent
Brown

(10) Patent No.: US 12,427,379 B2
(45) Date of Patent: Sep. 30, 2025

(54) ROPE WRENCH TETHER

(71) Applicant: International Safety Components Ltd, Gwynedd (GB)

(72) Inventor: Kevin Brown, Gwynedd (GB)

(73) Assignee: INTERNATIONAL SAFETY COMPONENTS LIMITED, Bangor (GB)

( * ) Notice: Subject to any disclaimer, the term of this patent is extended or adjusted under 35 U.S.C. 154(b) by 0 days.

(21) Appl. No.: 18/387,565

(22) Filed: Nov. 7, 2023

(65) Prior Publication Data

US 2024/0082643 A1 Mar. 14, 2024

(30) Foreign Application Priority Data

Sep. 9, 2022 (GB) ..... 2213229.4

(51) Int. Cl.
*A63B 29/02* (2006.01)
*A63B 29/08* (2006.01)

(52) U.S. Cl.
CPC ..... *A63B 29/02* (2013.01); *A63B 29/08* (2013.01)

(58) Field of Classification Search
None
See application file for complete search history.

(56) References Cited

U.S. PATENT DOCUMENTS 9,878,884 B1 * 1/2018 Ellis ..... B66D 3/006
10,207,130 B2 * 2/2019 Cooper ..... A62B 1/14
2012/0118666 A1 5/2012 Bingham

OTHER PUBLICATIONS

Notch Equipment; "Flow Adjustable Rope Wrench"; notchequipment.com; 2022.
TreeStuff, 2020, "Rope Logic FIX Tether—Double Eye", treestuff.com [online], Available from: https://www.treestuff.com/rope-logic-fix-tether-double-eye/ [Accessed Feb. 14, 2024]. See figure and accompanying description.

* cited by examiner

*Primary Examiner* — Vicky A Johnson
(74) *Attorney, Agent, or Firm* — Dickinson Wright PLLC; Andrew D. Dorisio

(57) ABSTRACT

A tether includes a length of rope with a primary loop at a midpoint for connection to a rope wrench, a pair of secondary loops remote from the primary loop, and a generally stiff but partially flexible rope cover between the primary and secondary loops, the rope cover being pre-curved along its length, the tether also including a tail-portion of the rope between the secondary loops and the rope cover, providing unrestricted 360° flexibility for the secondary loops, the rope cover sufficiently rigid to permit the handle end of the rope wrench to be pushed or pulled by hand and the rope cover retaining its curve to minimise the risk of a user's hand interfering with a hitch cord, and the tail portion of the tether is sufficiently flexible to withstand side-loads.

9 Claims, 3 Drawing Sheets

ROPE WRENCH TETHER

This application claims priority to British Patent Application No. 2213229.4 filed on Sep. 9, 2022, the disclosure of which is incorporated herein by reference.

TECHNICAL FIELD

This invention relates to rope wrenches as used by arborists or rock climbers when ascending an anchored rope, the rope wrench providing a mechanical advantage with which to aid ascent and control descent.

BACKGROUND

Rope wrenches of the foregoing type generally consist of a lever arm and a lever handle, the lever arm including a pair of bollards between which can be inserted the main rope, and upon pivoting of the handle about the axis of one of the bollards it induces serpentine or "S" shaped bending of the main rope whereby to assist ascent and also induce friction between the rope and the bollards in order to control descent.

As will be appreciated by those skilled in the art, the rope wrench handle must necessarily be positioned above a climber's harness and body and it is common to use a rigid or flexible but sufficiently stiff tether attached to the free end of the handle by which it may be pushed and pulled from below, effectively providing an articulated arm to the handle part of the rope wrench which is more easily accessible to the climber, who may also use the free end of the tether with which to connect it to couplings such as carabiners for connection to the climber.

Rigid tethers are usually made from drop-forged aluminium and are very strong under tension. They are usually pre-curved in the mid-section such that when grasped by the hand of a climber the hand does not rub against or otherwise interfere with the hitch cord around the main rope or a mechanical ascender or descender if used instead. However, they suffer from the disadvantage of bending or breaking when significant side loads are applied. This problem can be exacerbated when the mechanical strength of the tether has been compromised due to apertures being drilled or otherwise formed in the tether to which the climber can attach carabiners to connect the tether to the climber's chest harness. On the other hand, flexible tethers of rope are usually made by forming a primary loop at a midpoint in the length of rope and stitching the rope along most of its length and forming by stitching two secondary loops at the free ends of the length of rope, the primary loop permitting connection to a rope wrench and the secondary loops permitting connection to a carabiner, pulley and hitch cord. Unlike the pre-curved rigid tether, this type of tether is sewn in a straight line using a sewing machine and suffers from the disadvantage that because the tether is straight, when under tension in use, it does not allow sufficient room for the climber's hand to avoid rubbing against a hitch cord and possibly even dislodging it from its position around the main rope. In addition, because the stitching is along the whole length of the rope, when the process is completed it is found that the rigidising effect of the stitching makes the tether stiff in one direction but very loose and floppy in the orthogonal direction.

SUMMARY

The present invention is derived from the realisation that there is a need for a rope wrench tether in which the foregoing disadvantages are obviated.

According to the invention there is provided a rope wrench tether comprising or including a length of rope formed into a primary loop at a midpoint of the rope by which to permit connection to a rope wrench, the free ends of the rope being formed into a pair of secondary loops remote from the primary loop, and a generally stiff but partially flexible rope cover overlaying a mid-portion of the rope between the primary loop and the secondary loops, the rope cover being pre-curved along its length, the tether also including a tail-portion of the rope between the secondary loops and the rope cover, the tail portion providing unrestricted 360° flexibility for the secondary loops, the arrangement being such that the rope cover part of the tether is sufficiently rigid to permit the handle end of a rope wrench to be pushed or pulled by hand and for the rope cover to retain its curve whereby to minimise the risk of the hand of a user of the tether interfering with a hitch cord, and the tail portion of the tether is sufficiently flexible to withstand side-loads due to the inherent flexibility and strength of the rope.

With this arrangement the advantages of a rigid and curved rope wrench tether over a generally straight and stitched rope wrench tether permitting a degree of bending due to side loads during use are combined into a better solution by the elegant expedient of using a combination of part-rigid and fully flexible components but with the further advantage in that the tail portion of rope provides universal bending in all directions as opposed to being generally stiff in one direction due to a line of stitching and flexible in the direction orthogonal thereto.

By making the rope cover as a pre-formed curve it ensures that the user's hand is always kept away from a hitch cord, thereby obviating the risk otherwise of accidentally pulling the cord down and releasing its grip on the anchored main rope.

Preferably, the rope cover includes finger grips, which may be integral or provided separately by an elastomeric sheath, whereby to increase grip. The rope cover may also include one or more eyelet formations defining utility apertures for receiving carabiners, in which case it will be understood that the advantage to the climber of the provision of such additional utility apertures is not at the expense of weakening the tether, as in the case of metal tethers having such additional utility apertures.

Conveniently, the tail portion includes one or more protective sleeves, such as a shrink-wrapped sleeve for each end of the rope adjacent a secondary loop, preferably made from a transparent or partially transparent material such as adhesive-lined polyolefin shrink-tube which has the advantage of permitting inspection of the rope and any connecting stitches or other means of connecting the ends of the rope together in this region of the tether.

BRIEF DESCRIPTION OF THE DRAWINGS

The invention will now be described, by way of example only, with reference to the accompanying drawings in which.

DETAILED DESCRIPTION

Figure 1:
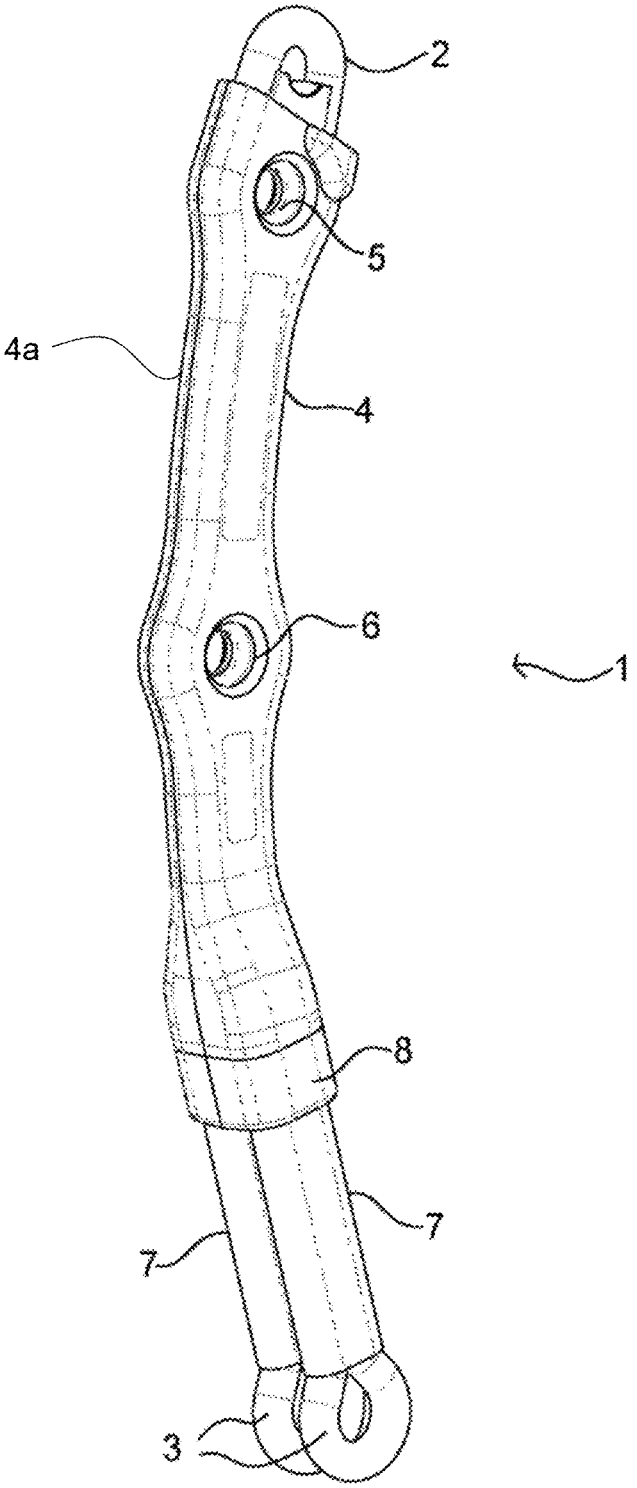
FIG. 1 is a perspective view of a tether made in accordance with the invention.

In FIG. 1 there is shown a rope wrench tether 1 having a primary loop 2 at one end and a pair of secondary loops 3 at the other end, between which is a semi-rigid but flexible pre-curved rope outer cover 4 which includes a pair of utility apertures 5, 6 for optionally receiving carabiners (not shown). Between the rope cover 4 and the pair of secondary loops 3 are a pair of transparent shrink-wrapped generally straight sleeves 7 of adhesive-lined polyolefin serving primarily to protect the rope of the tether in this region but also permitting inspection of the rope for wear. The ends of the sleeves 7 remote from the secondary loops 3 are enclosed by a collar 8 at the lower end of the rope cover 4 which provides a smoothly contiguous surface over which a hand or rope can glide without snagging the shrink-wrap sleeves 7 and also serving to prevent or inhibit the ingress of debris between the sleeves and the looped rope ends. The cover 4 may include finger grips 4*a*, as indicated, which may be integral or provided separately by an elastomeric sheath, whereby to increase grip.

Figure 2:
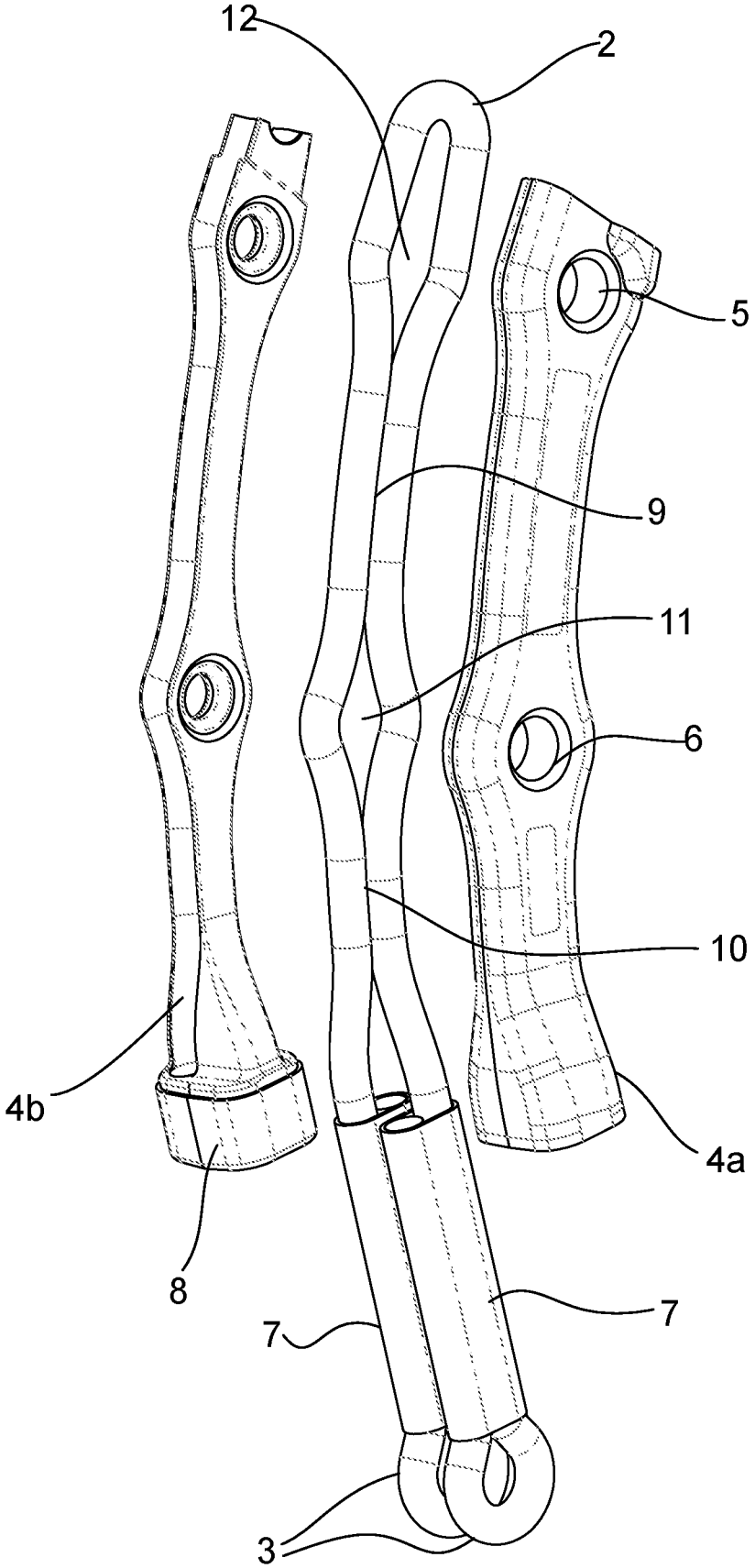
FIG. 2 is an exploded view of the tether of FIG. 1.

FIG. 2 shows an exploded view of the tether of FIG. 1 in which it will be seen that a mid-portion 9 of the looped rope between the utility apertures 5, 6 in the rope cover 4 is shaped by shrink-tube or by staples to be received in rope-receiving grooves (shown in broken outline) on the inside of the front part 4*a* of the rope cover 4, and a mid-portion 10 between the utility aperture 6 and the sleeves 7 is also shaped to be held in rope-receiving grooves on the inside of the front part 4*a* of the rope cover in the same manner, thereby creating therebetween another mid-portion 11 coincident with the aperture 6 in the cover 4. Similarly, an upper unstitched area 12 is provided coincident with the aperture 5 in the cover 4.

The front part 4*a* of the rope cover 4 is adapted for attachment to the rear part 4*b*, the latter including the whole of the collar 8 such that when assembling the tether 1, the two ends of the rope are threaded through apertures in the collar 8 and the secondary loops 3 are then stitched and covered with the shrink-wrapped sleeves 7 such that the collar 8 completely surrounds the end of the sleeves 7 next to the rope cover 4 whereafter the front part 4*a* is moulded over the rear part 4*b* to form the complete rope cover 4 as shown in FIG. 1.

Figure 3:
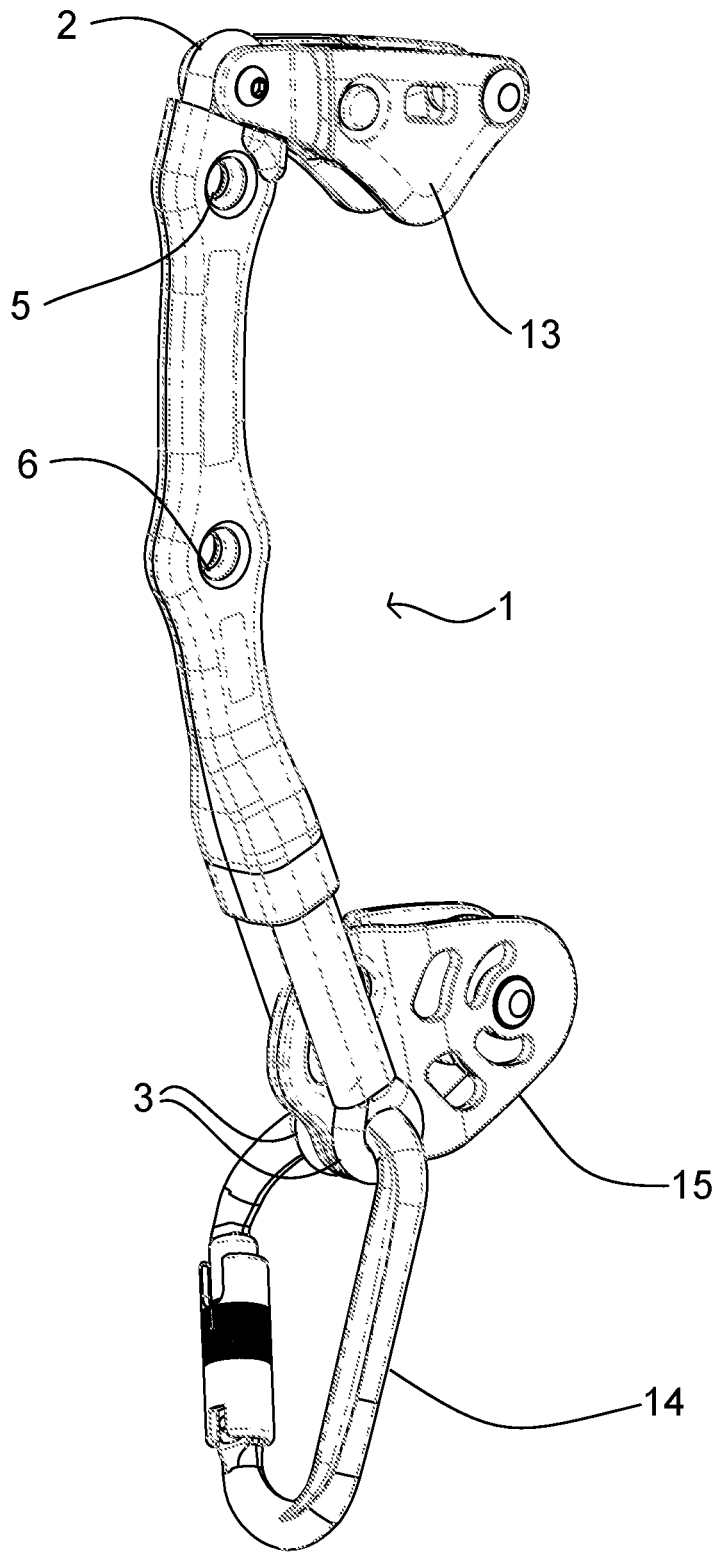
FIG. 3 shows the tether of FIG. 1 attached at each end to rope-climbing equipment.

FIG. 3 shows the complete tether 1 releasably secured at its upper end by the primary loop 2 to a rope wrench 13 and releasably secured at its lower end by the secondary loops 3 to a carabiner 14 to which is attached a pulley block 15.

In operation, the carabiner 14 is connected to a hitch cord (not shown) and the lower end of the carabiner 14 is also connected to e.g. the climbing harness (not shown) of a climber, with the pulley block 15 being used as necessary to assist the climber in ascending and descending. When carrying out these tasks and when moving from side to side by e.g. an arborist swinging from branch to branch in a tree, the pre-curved shape of the rope cover 4 minimises the risk of the hand of the arborist accidentally rubbing against a hitch cord or any rigid ascenders or descenders. In addition, the rope cover 4 is not only sufficiently rigid so as to retain its curved shape but there is little or no risk of it breaking or bending catastrophically as in the case of rigid aluminium tethers because it is never under tension, the tension being solely in the rope itself. However, even if the cover 4 breaks it does not affect the integrity of the tether 1 due to the fact that its tensile strength derives from the rope itself and not the rope cover 4. Also, because the cover 4 is non-metallic it will be appreciated that in cold weather there is little danger of the hands of the user becoming so cold as to impede function, an important consideration during inclement weather.

The invention therefore combines the best features of rigid tethers that are curved to fit the hand of a climber and the best features of non-rigid tethers that are not prone to catastrophic breakage, in a way that also adds the ability for the tail of the tether to easily flex in any direction, a distinct advantage over known rope wrench tethers.

The invention claimed is:

1. A rope wrench tether comprising or including a length of rope formed into a primary loop at a midpoint of the rope by which to permit connection to a rope wrench, the free ends of the rope being formed into a pair of secondary loops remote from the primary loop, and a generally stiff but partially flexible rope cover overlaying a mid-portion of the rope between the primary loop and the secondary loops, the rope cover being pre-curved along its length, the tether also including a tail-portion of the rope between the secondary loops and the rope cover, the tail portion providing unrestricted 360° flexibility for the secondary loops, the arrangement being such that a rope cover part of the tether is sufficiently rigid to permit a handle end of a rope wrench to be pushed or pulled by hand and for the rope cover to retain its curve whereby to minimise the risk of the hand of a user of the tether interfering with a hitch cord, and the tail portion of the tether is sufficiently flexible to withstand side-loads due to the inherent flexibility and strength of the rope.

2. The rope wrench tether according to claim 1 wherein the rope cover includes finger grips, whereby to increase grip.

3. The rope wrench tether according to claim 1 wherein the rope cover also includes one or more eyelet formations defining utility apertures for receiving carabiners.

4. The rope wrench tether according to claim 1 wherein the tail portion includes one or more protective sleeves.

5. The rope wrench tether according to claim 4 wherein the one or more protective sleeves are made from a transparent or partially transparent material.

6. The rope wrench tether according to claim 4, wherein the one or more protective sleeves include a shrink-wrapped sleeve for each end of the rope adjacent a secondary loop.

7. The rope wrench tether according to claim 5, wherein the transparent or partially transparent material is an adhesive-lined polyolefin shrink-tube.

8. A rope wrench tether comprising or including a length of rope formed into a primary loop at a midpoint of the rope by which to permit connection to a rope wrench, the free ends of the rope being formed into a pair of secondary loops remote from the primary loop, and a generally stiff but partially flexible rope cover overlaying a mid-portion of the rope between the primary loop and the secondary loops, the rope cover being pre-curved along its length, the tether also including a tail-portion of the rope between the secondary loops and the rope cover, the tail portion providing unrestricted 360° flexibility for the secondary loops, the arrangement being such that a rope cover part of the tether is sufficiently rigid to permit a handle end of a rope wrench to be pushed or pulled by hand and for the rope cover to retain its curve whereby to minimise the risk of the hand of a user of the tether interfering with a hitch cord, and the tail portion of the tether is sufficiently flexible to withstand side-loads due to the inherent flexibility and strength of the rope, wherein the rope cover includes finger grips whereby to increase grip.

9. A rope wrench tether comprising or including a length of rope formed into a primary loop at a midpoint of the rope by which to permit connection to a rope wrench, the free ends of the rope being formed into a pair of secondary loops remote from the primary loop, and a generally stiff but partially flexible rope cover overlaying a mid-portion of the rope between the primary loop and the secondary loops, the rope cover being pre-curved along its length, the tether also including a tail-portion of the rope between the secondary loops and the rope cover, the tail portion providing unrestricted 360° flexibility for the secondary loops, the arrangement being such that a rope cover part of the tether is sufficiently rigid to permit a handle end of a rope wrench to be pushed or pulled by hand and for the rope cover to retain its curve whereby to minimise the risk of the hand of a user of the tether interfering with a hitch cord, and the tail portion of the tether is sufficiently flexible to withstand side-loads due to the inherent flexibility and strength of the rope, wherein the tail portion includes one or more protective sleeves.

* * * * *